US012484679B2

(12) United States Patent
Hurtado

(10) Patent No.: US 12,484,679 B2
(45) Date of Patent: Dec. 2, 2025

(54) SHAVING RAZOR HANGER

(71) Applicant: The Gillette Company LLC, Boston, MA (US)

(72) Inventor: Armando Miguel Hurtado, Boston, MA (US)

(73) Assignee: The Gillette Company LLC, Boston, MA (US)

( * ) Notice: Subject to any disclaimer, the term of this patent is extended or adjusted under 35 U.S.C. 154(b) by 395 days.

(21) Appl. No.: 17/889,636

(22) Filed: Aug. 17, 2022

(65) Prior Publication Data

US 2024/0057741 A1 Feb. 22, 2024

(51) Int. Cl.
*A45D 27/29* (2006.01)

(52) U.S. Cl.
CPC ..... *A45D 27/29* (2013.01)

(58) Field of Classification Search
CPC ..... A45D 27/29; A45D 27/00; A45D 27/225; A45D 27/24; A45D 2200/25; B26B 19/00; B26B 19/386; B26B 21/4068; B26B 21/40
USPC ..... 30/541, 537; 211/88.01
See application file for complete search history.

(56) References Cited

U.S. PATENT DOCUMENTS 4,188,717 A * 2/1980 Mansfield ..... B26B 19/3833 248/230.2
D277,434 S * 2/1985 Iten ..... D6/526
D281,838 S 12/1985 Thompson
D283,260 S * 4/1986 Alvarez ..... D28/48
5,131,151 A * 7/1992 Agase ..... A47G 21/02 224/220
D333,583 S * 3/1993 Hurd ..... D6/526
D442,073 S 5/2001 Lyndon
6,330,948 B1 * 12/2001 Leto ..... A47J 47/20 248/206.3
6,886,792 B2 * 5/2005 Immerman ..... F16B 47/00 248/302
7,040,024 B2 * 5/2006 Lukan ..... A45D 27/29 211/88.01
D534,061 S 12/2006 Sakai
7,197,827 B2 * 4/2007 Paquette ..... B26B 21/52 30/526
D600,975 S 9/2009 Lin
7,698,823 B1 * 4/2010 Iadarola ..... B26B 21/40 30/296.1
D634,571 S 3/2011 Hanna
D650,669 S 12/2011 Dunwoody
D679,171 S 4/2013 Sedwick
(Continued)

FOREIGN PATENT DOCUMENTS

CN 203088960 U 7/2013
CN 209595616 U 11/2019
(Continued)

OTHER PUBLICATIONS

English Translation CN113100652 (Year: 2021).*
PCT Search Report and Written Opinion for PCT/US2023/072343 dated Oct. 13, 2023, 11 pages.

*Primary Examiner* — Jennifer S Matthews
(74) *Attorney, Agent, or Firm* — John M. Lipchitz

(57) ABSTRACT

A shaving razor hanger with a body having a top surface extending along a first plane and an opposing bottom surface extending along a second plane. A projection extending from the top surface. An elastomeric ring positioned on the projection.

20 Claims, 5 Drawing Sheets

(56) References Cited

U.S. PATENT DOCUMENTS

| | | | | |
|---|---|---|---|---|
| D827,327 | S | 9/2018 | Edwards | |
| D877,416 | S | 3/2020 | Lotti | |
| D889,162 | S * | 7/2020 | Elliott | D6/526 |
| D935,217 | S | 11/2021 | Hyun | |
| 11,499,588 | B1 * | 11/2022 | Longoria | F16B 45/012 |
| D975,925 | S | 1/2023 | Kim | |
| D980,049 | S * | 3/2023 | Desmarais | D8/373 |
| D981,221 | S | 3/2023 | Lin | |
| 2003/0196296 | A1 * | 10/2003 | Sonne | B25H 3/006 16/110.1 |
| 2015/0033470 | A1 * | 2/2015 | Sharratt | E03C 1/0408 4/695 |
| 2016/0368157 | A1 * | 12/2016 | Giannelli | B26B 21/523 |
| 2019/0017536 | A1 * | 1/2019 | White | F16M 13/022 |
| 2020/0290226 | A1 * | 9/2020 | Lucchese | B26B 21/521 |
| 2022/0175108 | A1 * | 6/2022 | Desmarais | A45D 27/29 |
| 2023/0051357 | A1 * | 2/2023 | Kovatch | A61Q 9/02 |

FOREIGN PATENT DOCUMENTS

| | | | | |
|---|---|---|---|---|
| CN | 210748969 | U | | 6/2020 |
| CN | 113100652 | A | | 7/2021 |
| KR | 20030073684 | A | * | 9/2003 |

* cited by examiner

SHAVING RAZOR HANGER

FIELD OF THE INVENTION

The present invention relates to personal care systems and more particularly to wall hangers for holding shaving razors.

BACKGROUND OF THE INVENTION

Personal care products include dry shaving razors, wet shaving razors, toothbrushes among other types of grooming and hygiene-related implements. An example of a dry shaving razor is an electric razor, which can be used without water, soap, or shaving cream. Wet shaving razors are typically used with water and soap or shaving cream. A wet shaving razor can include a replaceable cartridge in which one or more blades are mounted in a housing. After the blades in a cartridge have become dull from use, the cartridge is discarded, and a new cartridge is replaced on the handle. Personal care products are often stored on a sink, in a medicine cabinet, or on a shelf between uses. Accordingly, personal care products must not only be kept clean and dry between uses, but should also be aesthetically pleasing when displayed on a countertop or sink.

Today consumers have more options than ever before in choosing a shaving razor system. It is typical for consumers to have store the shaving razor on a stand. Accordingly, shaving razor(s) compete with numerous other products for space on the bathroom counter. Consumers may also choose to hang their razors on a hook. However, these are typically not very aesthetically pleasing and the razors may be accidently knocked off. A razor falling off a holder is even more problematic for more modern razors that are typically heavier and may even have electrical components that can break if the razor is dropped. Heavier razor handles may also be more likely to damage the razor cartridge and or blades, which can be dangerous.

Thus, it would be advantageous to provide for a personal care product that addresses one or more of these issues. Indeed, it would be advantageous to provide for a personal care product hanger for storing a handle in an aesthetically pleasing manner, thereby allowing a user to leave the personal care product(s) in view between uses while the personal care product(s) dries. It would also be advantageous to provide a hanger that is perceived as a premium product in view of its usability, functionality, looks, among other characteristics. For example, the handle would be easily attached to the hanger in a safe and secure fashion, but also easily removed. Other features and advantages of the invention will be apparent from the following detailed description, and from the claims.

SUMMARY OF THE INVENTION

The present disclosure fulfills the needs described above by, in one embodiment, providing a shaving razor hanger with a body having a top surface extending along a first plane and an opposing bottom surface extending along a second plane. A projection extending from the top surface. An elastomeric ring positioned on the projection.

In another aspect, the invention features, in general, a shaving razor system having a shaving razor having handle defining an opening. A hanger having a body with a top surface extending along a first plane and an opposing bottom surface extending along a second plane. A projection extends from the top surface of the body. A flexible ring positioned on the projection. The projection is positioned within the opening of the handle.

In another aspect, the invention features, in general a method of manufacturing a shaving razor system by providing shaving razor hanger having a body with a projection. A flexible ring is positioned within a groove defined by the projection. A shaving razor is provided having a handle defining an opening. The projection is inserted into the opening. An inner surface of the opening engages with the flexible ring.

BRIEF DESCRIPTION OF THE DRAWINGS

The above-mentioned and other features and advantages of the present disclosure, and the manner of attaining them, will become more apparent, and the disclosure itself will be better understood by reference to the following description of nonlimiting embodiments of the disclosure taken in conjunction with the accompanying drawings, wherein.

DETAILED DESCRIPTION OF THE INVENTION

The present disclosure provides for personal care systems having a handle and a hanger for docking the handle when not in use. Various nonlimiting embodiments of the present disclosure will now be described to provide an overall understanding of the principles of the function, design, and operation of the personal care product systems. One or more examples of these nonlimiting embodiments are illustrated in the accompanying drawings. Those of ordinary skill in the art will understand that the methods described herein and illustrated in the accompanying drawings are nonlimiting example embodiments and that the scope of the various nonlimiting embodiments of the present disclosure are defined solely by the claims. The features illustrated or described in connection with one nonlimiting embodiment may be combined with the features of other nonlimiting embodiments. Such modifications and variations are intended to be included within the scope of the present disclosure.

Figure 1:
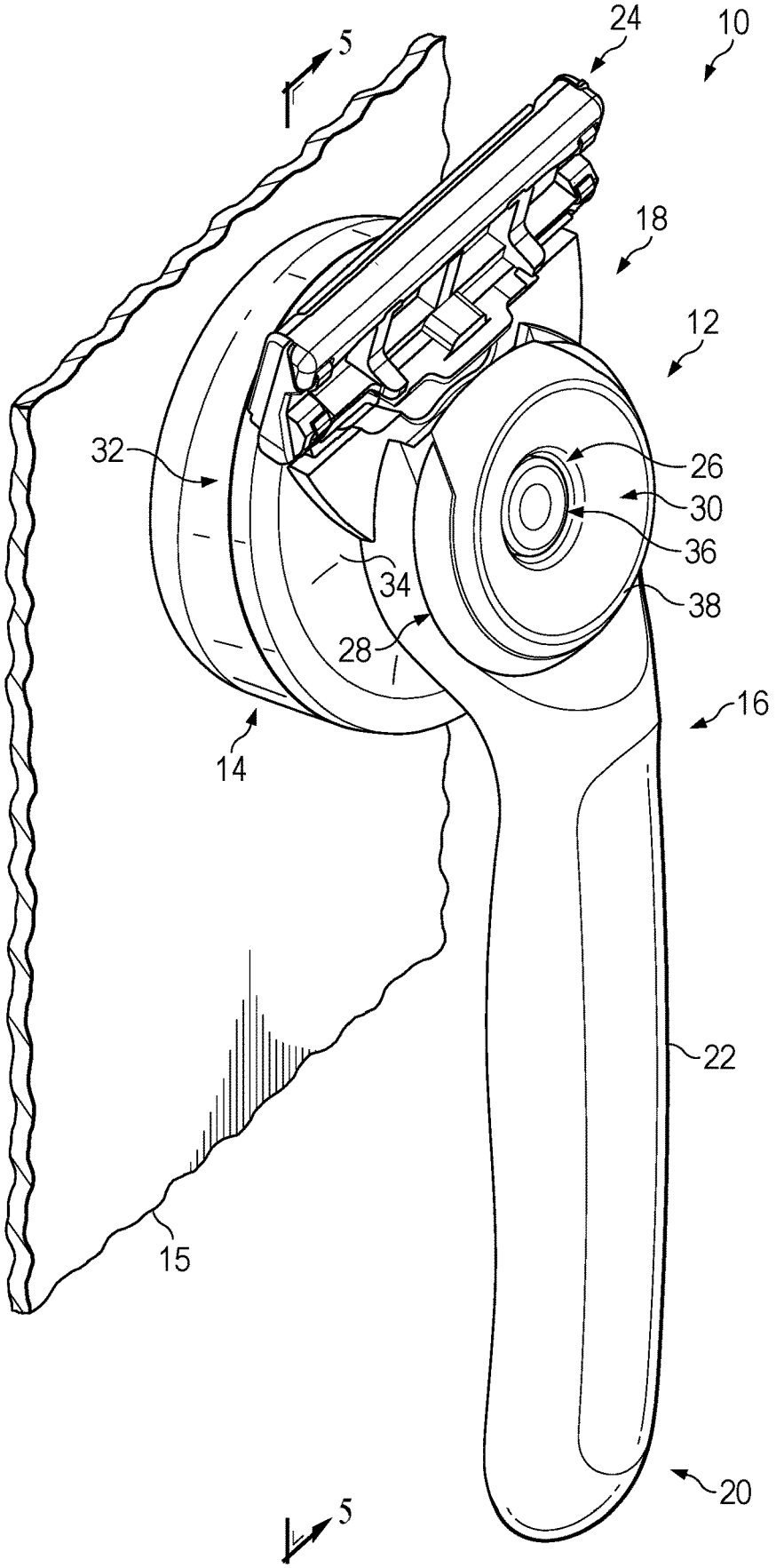
FIG. 1 is a perspective view of a shaving razor mounted to a shaving razor hanger.

Referring now to FIG. 1, a perspective view of a shaving razor system 10 is illustrated with a shaving razor 12 mounted to a shaving razor hanger 14, in accordance with one nonlimiting embodiment of the present disclosure. The shaving razor hanger 14 may be secured to a mounting surface 15, such as a shower wall, medicine cabinet or mirror. The shaving razor hanger 14 may be secured to the mounting surface 15 utilizing commonly known methods such as adhesives strips or suction cups. In certain embodiments, the shaving razor hanger 14 may facilitate positioning the shaving razor 12 away from the mounting surface 15. The shaving razor hanger 10 may be capable of holding the shaving razor 12 in a generally upright position, as shown in FIG. 1.

Figure 2:
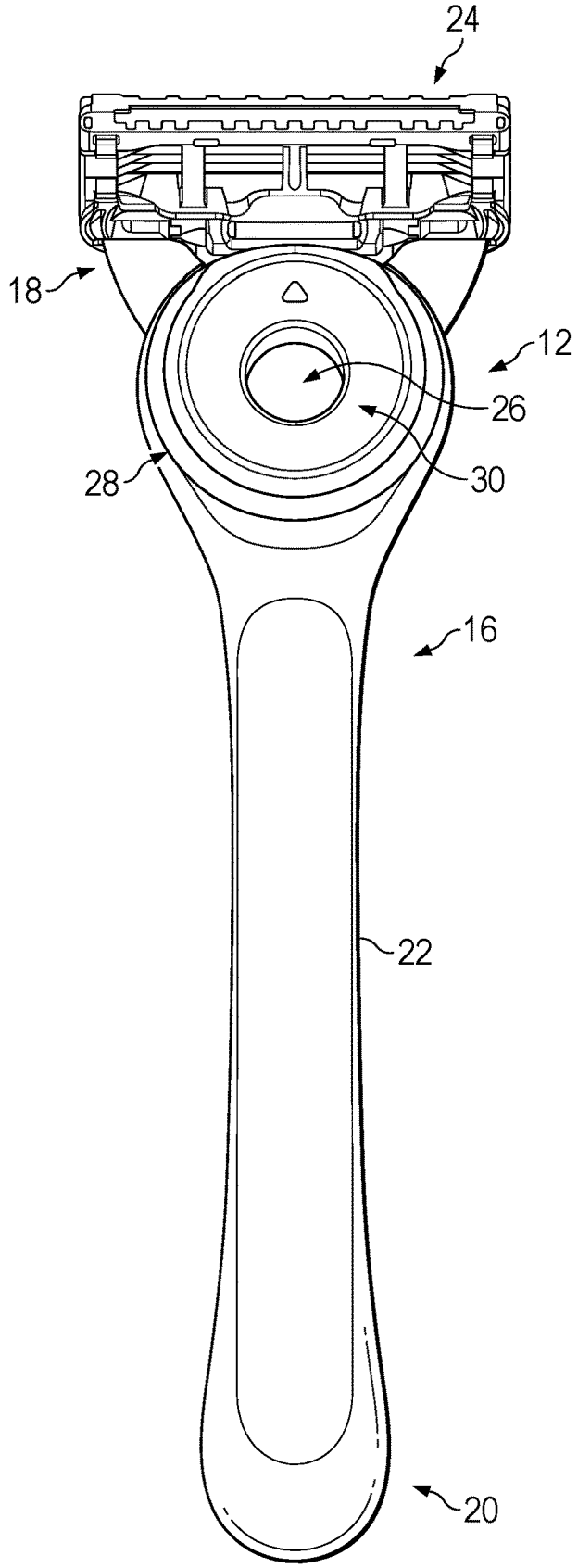
FIG. 2 is a front view of a shaving razor.

Now with additional reference to FIG. 2, the shaving razor 12 may have a handle 16 with a proximal end 18, a distal end 20 and a gripping portion 22 between the proximal end 18 and the distal end 20. A shaving razor cartridge 24 may be mounted to the proximal end 18 of the handle 16. The handle 16 may define an opening 26 to facilitate temporarily attaching the handle 16 to the shaving razor hanger 14. The opening 26 may be positioned in a neck 28 of the handle 16 between the gripping portion 22 and the proximal end 18. However, it is understood that the opening 26 may be positioned anywhere along the handle 16, including the distal end 20. In certain embodiments, the opening 26 may extend completely through the handle 16 (e.g., neck 28), as shown in FIG. 2. The neck 28 may have a recessed surface 30 that slopes in a downward direction toward the opening 26. The shaving razor hanger 14 may include a body 32 having a top surface 34 (FIG. 1). A projection 36 may extend from the top surface 34 of the body 32. The projection 36 may facilitate attachment of the shaving razor 12 to the shaving razor hanger 10. The projection 36 may have a generally cylindrical shape, but other geometries are possible. In certain embodiments, the projection 36 may extend completely through the opening 26, but may be recessed relative to an outer rim 38 of the recessed surface 30. Accordingly, the recessed surface 30 may facilitate removal of the shaving razor 12 from the shaving razor hander 14 by allowing a user's thumb (or other digit) to engage (e.g., press against) the projection 36 to separate the handle 16 from the projection 36 of the shaving razor hanger 14.

Figure 3:
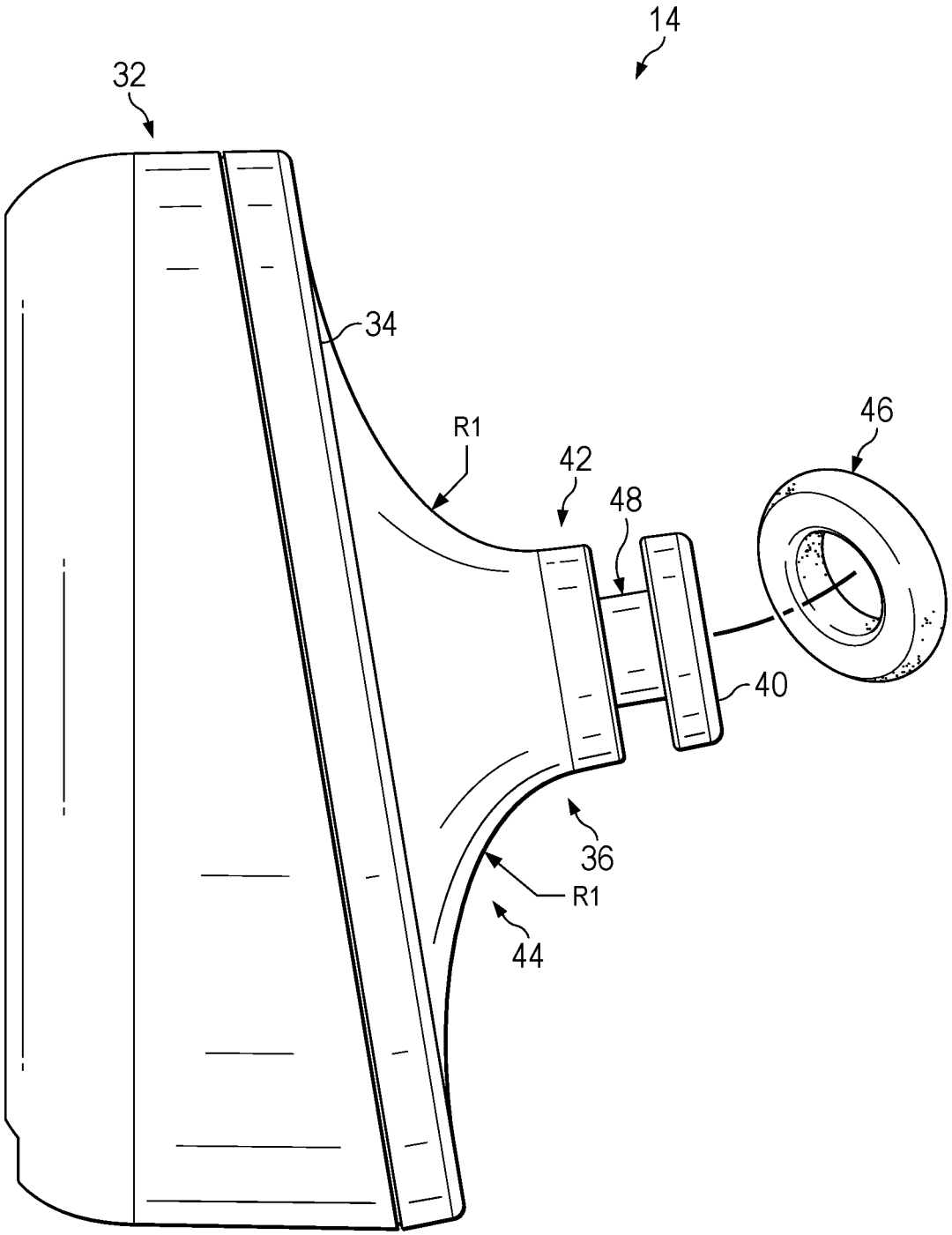
FIG. 3 is perspective assembly view of the shaving razor hanger.
Figure 4:
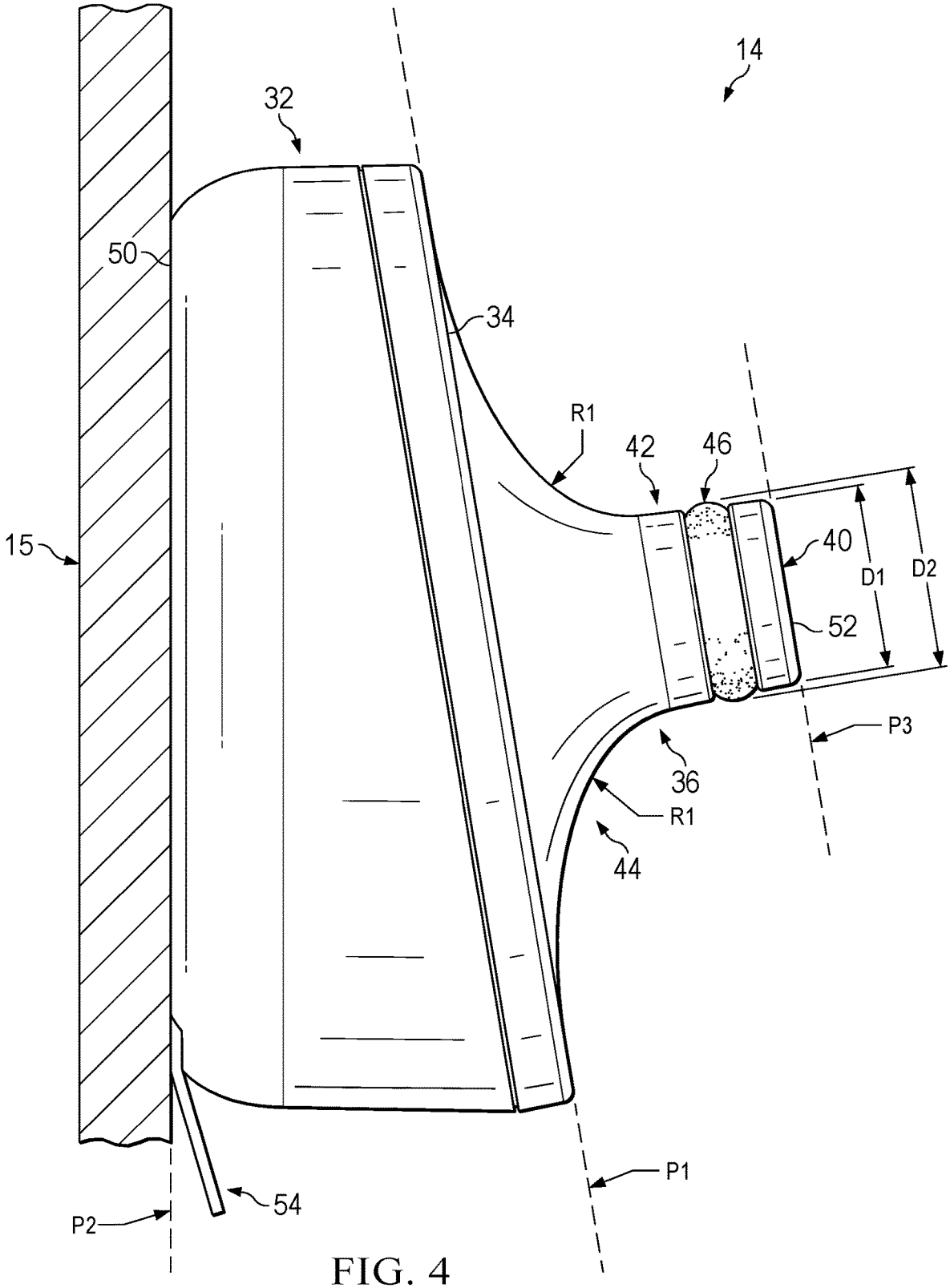
FIG. 4 is a side view of the shaving razor hanger.

Referring to FIGS. 3 and 4, a side assembly view and a side view of the shaving razor hanger 14 is illustrated, respectively. The projection 36 of the shaving razor hanger 14 may have a distal end 40, opposite the top surface 34 of the body 32. The projection 36 may have a straight portion 42 between the distal end 40 and the top surface 34. The projection 36 may taper from an enlarged region 44 to the straight portion 42. The enlarged region 44 may have a radius "R1" of about 20 mm to about 50 mm. In certain embodiments, the enlarged region 44 may be arcuate and may have a diameter larger than the straight portion 42 to facilitate proper positioning of the handle 16 (FIG. 2) on the shaving razor hanger 14. The straight portion 42 may have a length extending from the distal end 40 to an area where the projection 36 begins to taper toward the enlarged region 44 of about 4 mm to about 8 mm and preferably about 5 mm to about 7 mm.

A flexible ring 46 (e.g., an O-ring) may be positioned on the projection 36. For example, the projection 36 (e.g., the straight portion 42) may define a groove 48 FIG. 3 extending around the projection 36 (e.g., the straight portion 42). In certain embodiments, the flexible ring 46 may comprise one or more synthetic rubbers, such as silicone rubber and Styrene-butadiene rubber (SBR). The flexible ring 46 may also comprise various thermoplastic elastomers. However, it is understood the material composition of the flexible ring 46 may vary depending on chemical compatibility, application temperature, sealing pressure, lubrication requirements, durometer, size and cost. The flexible ring 46 may be loop with a round cross section. The groove 48 may be dimensioned to receive a flexible ring 46. The flexible ring 46 may have a diameter (when positioned within the groove 48) that is greater than a diameter of the straight portion 42 and/or a diameter of the distal end 40. Accordingly, when the projection 36 is inserted into the opening 26 of the handle 16, as shown in FIG. 1, the elastomer ring 46 may compress to facilitate attachment of the shaving razor 12 to the shaving razor hanger 14. In certain embodiments, the handle 16 may be secured between the elastomeric ring 46 and the top surface 34 of the shaving razor hanger 14. Alternately, the elastomeric ring 48 may be positioned within the opening 26 of the handle 16. The distal end 40 of the projection 36 may have an outer diameter "D1". The diameter "D1" may also represent the diameter o the straight portion 42 of the projection 36. An outside diameter "D2" of the flexible ring 46 may be about of about 6 mm to about 10 mm and preferably about 7 mm to about 9 mm. The diameter "D2" of the flexible ring 46 may be slightly greater than a diameter "D 1" of the distal end 40 and/or the straight portion 42 to hold the handle 16 securely in place when the handle 16 of FIG. 1 is not in use. For example, D1 may be about 5% to about 10% greater than "D2". Accordingly, the handle 16 of FIG. 1 may be temporarily secured in place between the enlarged region 44 and the flexible ring 46. An internal diameter of the flexible ring 46 may be less than the diameter "D1" and/or a diameter of the groove 48, so the flexible ring 46 fits securely on the projection 36.

Referring to FIG. 4, the top surface 34 may be opposite a bottom surface 50 and may extend along a first plane P1. The bottom surface 50 may be flat and not parallel to the top surface. For example, the bottom surface 50 may extend along a second plane P2, which may be parallel to the mounting surface 15. The first plane P1 may not be parallel to the second plane P2. For example the first plane P1 may intersect the second plane P2 at an included angle of about 5 degrees to about 20 degrees and more preferably about 8 degrees to about 12 degrees. The non-parallel top surface 34 and bottom surface and 50 may facilitate the shaving razor 12 to rest on the shaving razor hanger 14 with the neck 28 parallel to P2 and/or the mounting surface 15, which may provide better ergonomics. For example, the angle of the top surface 34 relative to the bottom surface 50 may allow a shorter length of the projection 36 and/or for a lower profile shaving razor hanger 14, especially for shaving razors having arcuate profile. Shaving razors having an arcuate profile may interfere with the mounting surface 15 when they are placed on a shaving razor hanger. Accordingly, the shaving razor hanger 14 may facilitate the shaving razor 12 not contacting the mounting surface 15. In certain embodiments, the distal end 40 may have a top surface 52 that extends along a third plane P3 that is parallel to the first plane P1, but not parallel to the second plane P2. The top surface 52 may be flat to allow a consumer to push against to help remove the shaving razor 12 (FIG. 2). The bottom surface 50 may include an adhesive strip 54 to keep the shaving razor hanger 14 secured to the mounting surface 15, even as the shaving razor 12 (FIG. 2) is repeatedly attached and removed from the shaving razor hanger 14.

Figure 5:
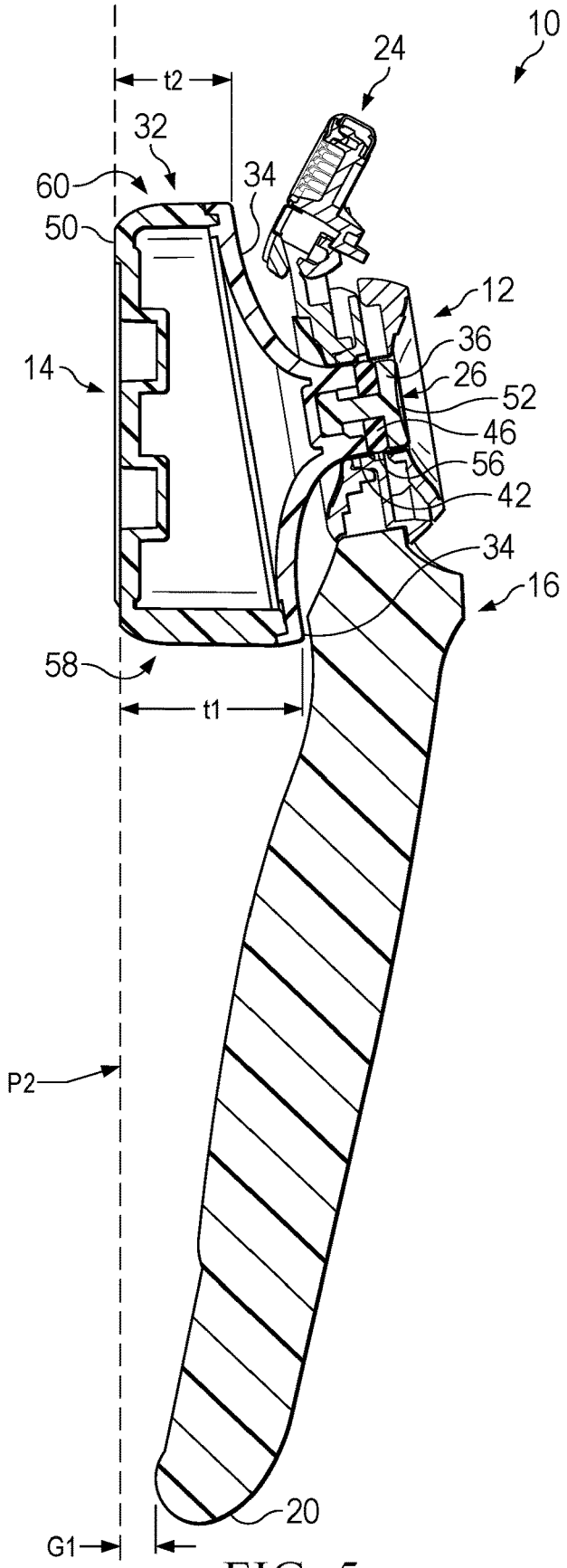
FIG. 5 is a cross sectional view of the shaving razor and shaving razor stand, taken generally along the line 5-5 of FIG. 1A.

Referring to FIG. 5, a cross section view of the shaving razor system 10, taken generally along the line 5-5 of FIG. 1, is illustrated. The shaving razor 12 may be temporarily secured to the shaving razor hanger 14 with the shaving razor cartridge 24 spaced apart from the top surface 34 of the body 32 of the shaving razor hanger 14, which may facilitate in drying the shaving razor 12 (e.g., the shaving razor cartridge 24). The handle 16 (e.g., the distal end 20) may be spaced apart from the plane P2 by a gap G1. In certain embodiments, G1 may be about 1 mm to about 5 mm and preferably about 2 mm to about 3 mm. Accordingly, the shaving razor hanger 14 may prevent the handle 16 from contacting the mounting surface 15 (FIG. 4). The projection 36 may be positioned within the opening 26 of the handle 16. In certain embodiments, the projection 36 may extend beyond the opening 26 to allow a user finger to press against the top surface 52 of the projection 36 to facilitate removal of the shaving razor 12 from the shaving razor hanger 14. The flexible ring 46 may engage an inner surface 56 of the opening 26. The flexible ring 46 may be compressible to facilitate securement of the handle 16 to the shaving razor hanger 14, so the shaving razor 12 does not become inadvertently dislodged from the shaving razor hanger 14. The straight portion 42 of the projection 36 may not engage the inner surface 56 of the opening 26 (e.g., spaced apart), which may allow the handle 16 to be removed from the shaving razor hanger 14 with an appropriate amount of force. Accordingly, the engagement of the flexible ring 46 may be the determining factor in the amount of force required to remove the handle 16 from the shaving razor handle 16, which may help accommodate for tolerance issues.

The body 32 may have a lower portion 58 positioned below the projection 36 having a thickness "t1" between the top surface 34 and the bottom surface 50 that is greater than a thickness "t2" of an upper portion 58 positioned above the projection 36 between the top surface 34 and the bottom surface 50 of the body 32 of the shaving razor hanger 14. In certain embodiments, t1 may be about 15 mm to about 25 mm and preferably about 15 mm to about 20 mm. In addition, t2 may be about 5 mm to about 15 mm and preferably about 8 mm to about 12 mm.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm." Furthermore, dimensions should not be held to an impossibly high standard of metaphysical identity that does not allow for discrepancies due to typical manufacturing tolerances. Therefore, the term "about" should be interpreted as being within typical manufacturing tolerances.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor hanger comprising:

a body having a top surface extending along a first plane and an opposing bottom surface extending along a second plane which is not parallel to the first plane, the bottom surface configured to be secured to a mounting surface;

a projection extending from the top surface; and an elastomeric ring positioned on the projection configured to secure a shaving razor handle.

2. The shaving razor hanger of claim 1 wherein the projection defines a groove and the elastomeric ring is positioned within the groove.

3. The shaving razor hanger of claim 1 wherein the body has a bottom attachment surface that comprises an adhesive strip.

4. The shaving razor hanger of claim 1 wherein the body has a bottom surface that comprises an adhesive strip.

5. The shaving razor hanger of claim 1 wherein the body has a bottom surface that is flat and not parallel to the top surface.

6. The shaving razor hanger of claim 5 wherein the body has a lower portion below the projection having a thickness between the top surface and the bottom surface that is greater than a thickness between the top surface and the bottom surface at an upper portion above the projection.

7. The shaving razor hanger of claim 1 wherein the first plane intersects the second plane at an included angle of 5 degrees to 20 degrees.

8. The shaving razor hanger of claim 1 wherein the projection is cylindrical.

9. The shaving razor of claim 1 wherein the elastomer ring has a diameter that is greater than a diameter of a distal end of the projection.

10. The shaving razor hanger of claim 1 wherein the projection is cylindrical.

11. The shaving razor hanger of claim 1 wherein in the flexible ring has a diameter greater than a diameter of a distal end of the projection.

12. A shaving razor system comprising:

a shaving razor having a handle defining an opening; and a hanger comprising:

a body having a top surface extending along a first plane and an opposing bottom surface extending along a second plane which is not parallel to the first plane;

a projection extending from the top surface; and a flexible ring positioned on the projection, wherein the projection and the flexible ring are positioned within the opening.

13. The shaving razor system of claim 12 wherein the flexible ring engages an inner wall of the opening to facilitate securement of the handle to the hanger.

14. The shaving razor system of claim 12 wherein the opening extends completely through the handle.

15. The shaving razor system of claim 12 wherein the projection defines a groove and the flexible ring is positioned within the groove.

16. The shaving razor system of claim 12 wherein the body has a bottom attachment surface that comprises an adhesive strip.

17. The shaving razor system of claim 12 wherein the bottom surface is flat and not parallel to the top surface.

18. The shaving razor system of claim 12 wherein the projection has a straight portion spaced apart from an inner surface of the opening.

19. The shaving razor hanger of claim 12 wherein the first plane intersects the second plane at an included angle of 5 degrees to 20 degrees.

20. A method of manufacturing a shaving razor system comprising:

providing shaving razor hanger having a body with a projection;

positioning a flexible ring within a groove defined by the projection;

providing a shaving razor having a handle defining an opening;

inserting the projection into the opening; and engaging an inner surface of the opening with the flexible ring.

* * * * *